US012789058B2

(12) United States Patent
Filippini

(10) Patent No.: US 12,789,058 B2
(45) Date of Patent: Nov. 10, 2026

(54) PICKLEBALL PADDLE WITH CONTROLLABLE BALL DWELL AND METHOD

(71) Applicant: Gearbox, Inc., San Diego, CA (US)

(72) Inventor: Rafael G. Filippini, San Diego, CA (US)

(73) Assignee: GEARBOX, INC., San Diego, CA (US)

( * ) Notice: Subject to any disclaimer, the term of this patent is extended or adjusted under 35 U.S.C. 154(b) by 531 days.

(21) Appl. No.: 18/220,966

(22) Filed: Jul. 12, 2023

(65) Prior Publication Data

US 2024/0017141 A1 Jan. 18, 2024

Related U.S. Application Data

(60) Provisional application No. 63/388,512, filed on Jul. 12, 2022.

(51) Int. Cl.

| | |
|---|---|
| ***A63B 59/42*** | (2015.01) |
| ***A63B 59/48*** | (2015.01) |
| ***A63B 60/00*** | (2015.01) |
| ***A63B 60/18*** | (2015.01) |
| ***A63B 60/52*** | (2015.01) |

(52) U.S. Cl.

CPC ..... *A63B 59/42* (2015.10); *A63B 59/48* (2015.10); *A63B 60/0081* (2020.08); *A63B 60/18* (2015.10); *A63B 60/52* (2015.10)

(58) Field of Classification Search

CPC ..... A63B 59/42; A63B 59/48; A63B 60/0081; A63B 60/18; A63B 60/52; A63B 60/54; A63B 2209/00

See application file for complete search history.

(56) References Cited

U.S. PATENT DOCUMENTS

| | | | | | |
|---|---|---|---|---|---|
| 2,082,772 | A | * | 6/1937 | Adams | A63B 49/08 473/546 |
| 2,205,578 | A | * | 6/1940 | Schnur | A63B 60/18 473/529 |
| 2,230,177 | A | * | 1/1941 | Caines | A63B 60/00 473/540 |
| 2,328,366 | A | * | 8/1943 | Timmermann | A63B 59/40 473/529 |
| 4,768,786 | A | | 9/1988 | Kuebler | |
| 4,919,438 | A | | 4/1990 | Yoneyama | |
| 5,060,944 | A | * | 10/1991 | Janes | A63B 49/03 473/539 |

(Continued)

FOREIGN PATENT DOCUMENTS

| | | | |
|---|---|---|---|
| CN | 2684889 | Y * | 3/2005 |
| CN | 2693306 | Y * | 4/2005 |

(Continued)

OTHER PUBLICATIONS

Office Action dated Jul. 16, 2026 in Chinese Patent Application No. 202310853889.7.

*Primary Examiner* — Audrey B. Walter
(74) *Attorney, Agent, or Firm* — Procopio, Cory, Hargreaves & Savitch LLP

(57) ABSTRACT

A composite molded sports paddle comprising a head with a paddle face; a handle; and a transition area between the head and the handle, wherein the transition area includes a ball dwell control mechanism.

7 Claims, 6 Drawing Sheets

(56) References Cited

U.S. PATENT DOCUMENTS

| | | | | | |
|---|---|---|---|---|---|
| 5,865,694 | A | | 2/1999 | Duong-Van | |
| D596,682 | S | * | 7/2009 | Severa | D21/730 |
| 8,002,651 | B2 | * | 8/2011 | Babolat | A63B 49/10 473/546 |
| D836,736 | S | * | 12/2018 | Kowalke | D21/729 |
| D952,780 | S | * | 5/2022 | Bonfigli | D21/729 |
| D1,029,158 | S | * | 5/2024 | Bird | D21/753 |
| 2008/0254921 | A1 | * | 10/2008 | Pai | A63B 49/03 473/524 |
| 2010/0048333 | A1 | * | 2/2010 | Cottey | A63B 60/54 473/535 |
| 2014/0183821 | A1 | * | 7/2014 | Kueng | A63B 60/52 273/330 |
| 2016/0339312 | A1 | * | 11/2016 | Bonfigli | A63B 60/28 |
| 2022/0032141 | A1 | * | 2/2022 | Brents | A63B 60/54 |
| 2022/0088449 | A1 | * | 3/2022 | Marshall | A63B 59/42 |
| 2023/0191215 | A1 | * | 6/2023 | Barnes | A63B 59/48 473/527 |

FOREIGN PATENT DOCUMENTS

| | | | | | |
|---|---|---|---|---|---|
| CN | 202497672 | U | * | 10/2012 | |
| CN | 105617629 | A | * | 6/2016 | A63B 59/40 |
| CN | 208541766 | U | * | 2/2019 | |
| WO | WO-2019210809 | A1 | * | 11/2019 | A63B 60/06 |

* cited by examiner

PICKLEBALL PADDLE WITH CONTROLLABLE BALL DWELL AND METHOD

FIELD OF THE INVENTION

The subject matter discussed herein relates generally to composite sports paddles wherein the manipulation at impact of the ball and paddle produces beneficiary outcomes depending on the style of play of the individual striking the ball. There are players who focus more on power, some players focus more on control, while others have a particular focus on the amount of spin they produce over the ball at impact, and most would like to have a combination of all.

BACKGROUND

Sports paddles of today are generally comprised of composite materials including fibrous unidirectional or woven fibers impregnated with thermal set resins that make up the outer surface plies and handle area, while the hitting internal surface area is generally constructed of a honeycomb plastic material. The traditional honeycomb paddle construction has tremendous limitations regarding weight, strength, and control of bending and torsional moments. Recently with the introduction of molded internally pressurized paddles, including rib structure to replace honeycomb structure have improved the durability, play, and can more accurately manipulate the bending and torsional design of the paddles. However, there are still limitations with fibrous material and thermal setting resin structure and thus further manipulation of the mechanical structure is required to achieve optimal performance characteristics.

Traditionally, the frame of sports paddles were made of wood. More recently, paddles have been made from aluminum core, foam cores, honeycomb core, and composite materials. In a more traditional wood or aluminum structure, the paddle is made entirely using these materials, which are cut to the desired finished shape. To complete the paddle a handle is then built up using additional wood, aluminum or other materials to increase the circumference of the handle. This process limits the weight to strength ratios as well as the ability to customize weight, balance, and the like. Traditional paddles are made of solid wood, injected plastics, or composite fiber with honeycomb cores. All four of these paddles have tremendous disadvantages due to the construction methods and the limits due to the materials and technology. The paddles of today rely on these homogeneous structures that limit the weight distribution and overall weight, leaving them with limited performance characteristics. Further, the more advanced paddles with honeycomb cores are also limited due to how the panel is cut, which leaves the core edges exposed with a gap between the top and bottom surface plies. The gap allows for easy destruction of the paddle, so a plastic cover is normally added around the edges creating a step around the edges which result in a non-uniform hitting surface. As a result, if the ball strikes near the edge, it will change direction. Yet another problem with the paddles of today is the handle. The handle is also a build-up of different materials from the surface and requires additional processing to complete. The appearance is a non-esthetic assembly of various pieces. Yet another problem with solid sports paddle construction is the sound produced at impact. The core is usually made of an entirely rigid material giving out loud sounds on impact. Cores or other dampening materials are not added due to the weight restrictions or difficulty to manufacture.

Solid face hitting areas are often made from wood and aluminum alloy materials. Due to the ease of manufacturing these structures, solid wood or aluminum structures have been used to produce low price, low technological, and mass-production paddles. These solid face structures have many limitations, mostly due to the materials and limited use of these materials. The frame and solid face structures cannot be manipulated to increase strength, stiffness, or change the shape of said structures. Additionally, wood, aluminum, and honeycomb composite structures are heavy and lack strength.

In recent years, composite frame and face structures are used in paddle manufacture, mostly of the higher strength-to-weight ratio in composite paddle frame and face construction. Combinations of materials such as carbon, aramid fiber, fiberglass, boron, and other fibrous material have been used to manufacture sports paddles. This can produce paddles that are more rigid, lighter, and larger, thus improving the player's ability and advancing the evolution of each individual sport.

Paddle frames of composite paddles are sometimes produced by bladder molding where a structure is created by using compressed air, chemical reactions to increase pressure, or hot gasses to apply internal pressure within the structure, thus forcing the material to the predetermined edges of the rigid mold shape. At this time, when pressure is added to the structure, the mold and the part is heated to a temperature which that accelerated the catalyst process to harden the structure. Once hardened, usually using thermal set resins, a rough paddle frame structure is created.

When producing paddles utilizing bladder molded internally pressurized molded techniques, the shape of the frame or paddle both in length, width, and depth can more efficiently control. The shape does not have to be uniform through the paddle and the shape can vary or even be interrupted to help provide improved bending and torsional moments. When producing fibrous structures, varying the angle of the plies does provide tremendous variations in bending and torsional stiffness throughout the frame shape. However, adding a mechanical shape change along with the fiber angles helps provide more precise and a larger range of manipulation for flex and torsion of the paddle.

In the current evolution of the sport of pickleball, players are demanding more from the paddles being produced. Players are demanding more durability, more power, control, spin and durability. Thus, utilizing the molded bladder techniques and manipulating the hitting surface, the region between the hitting surface, and manipulating the handle area to improve dwell time, dwell time can be further increased or reduced between the ball and paddle to the necessary outcomes demanded by today's players.

SUMMARY

An aspect of the disclosure involves a composite pickleball paddle having opposed outer surfaces and a core comprising a plurality of ribs or a honeycomb panel connecting between and connected to the outer walls, frame structure and handle. The outer panel surfaces, the frame structure, handle, and internal chamber walls or ribs are made of a woven or non-woven fibrous material, or a honeycomb core structure may be used to fill the internal hitting surface. The section connecting the head portion (hitting area) is connected to a handle, this transition area between the handle and head portion is particularly important in the sports of pickleball as it helps determine the dwell time the ball will have with the paddle at impact and thus becoming important to feel, control, power, and spin or the ball during and after striking the ball. Pickleball USAP has a particular set of rules that limit the deflection of the striking surface and thus limiting the trampoline effect of the ball and hitting area. So, by controlling the dwell time in the transition area the effective "spring rate of the paddle" can be manipulated to provide either more power, control, spin or a combination thereof.

Another aspect of the disclosure involves a composite internally pressurized molded paddle, where the shape of the paddles can be significantly altered, particularly in the region where the hitting surface and handle meet, to reduce or increase stiffness and further enhance the bending or stiffness characteristics of the fibrous materials that make up the paddle. The manipulation of stiffness and bending are directly proportional to ball exit velocity, increased dwell time for control, and ball spin.

An additional aspect of the disclosure involves a composite internally pressurized molded paddle including an open throat design, which can be created with the connection of the hitting surface and handle having one or two tubular connections between the head and handle of the paddle. Further, the connecting tubular sections can be constructed in varying diameters, shapes, and lengths to help create desired elasticity and resistant moments to manage dwell time upon ball and paddle impact. Creating molded paddles, as opposed to the traditional methods of making pickleball paddles, utilizing a honeycomb cut out structure, creating an open throat piece or section was not commercially possible, as the structure of the honeycomb would not be sufficient in strength. In the open-throat design in the present disclosure, it is possible to encompass a honeycomb face or fibrous rib structure to make the stringing surface of the paddle and join the head of the paddle to the handle by a couple of connection tubular surfaces. Equally, in making the open-throat design and achieve improve bending and torsional enhancements, the opening can be created along the center line near the throat of the paddle on the same plane as the paddle face. Creating such a slot on the side and going through between both paddle faces near the handle, a more flexible throat region is created to increase flexibility and torsion to improve dwell time and, thus, improve control and spin.

Another aspect of the disclosure involves a composite internally pressurized molded paddle including reduced thickness in a paddle throat section, in the same plane as the face of the paddle. In this aspect, the design is on the same plane as the face of the paddle or includes a narrowing of the handle transition area perpendicular to the striking surface of the paddle. Thus, creating a narrower transition will improve flexibility in the throat area and thus improve dwell by having the paddle absorb part of the balls energy resulting in improved control. To produce a more powerful or stiffer paddle, the thickness at the throat region can be increased along the planar direction of the paddle face to minimize the paddle's overall flexibility and, thus, return more energy to the ball, resulting in a more powerful shot.

A further aspect of the disclosure involves a composite internally pressurized molded paddle including a reduced thickness in a paddle throat section perpendicular to the face of the paddle. A reduced or thinner section at the throat will help create a hinge effect near the handle and throat to improve flexibility of the paddle face in the direction of the shot. Having the paddle face flex in the direction of the shot improves ball dwell time on the paddle face and, thus, increasing the time the ball stays on the paddle face. This additional time the ball stays on the paddle face will help improve ball direction, more control, and significantly improve spin.

A still further aspect of the disclosure involves a composite internally pressurized molded paddle including a two-piece paddle—one containing the head portion of the paddle and the second the handle of the paddle. The two pieces would be joined by a slot or connection section in which a membrane made of rubber or malleable material is sandwiched between the head portion and handle section in the area where the two pieces come together. In this design, the thickness, durometer and type of malleable material can vary to achieve varying flex dimensions. A further advantage of creating two separate paddle sections is to utilize materials that are vibration absorbing materials to damper the vibration frequency at ball impact.

An additional aspect of the disclosure involves a composite internally pressurized molded paddle including power and control in one paddle—a slit or separation in the transition area is created, where one side of the face is detached from the handle and face, yet the opposing side remains as one continuous piece. By creating a groove or slit in the center of the handle in the planar direction of the paddle face and disconnecting one face while leaving the other connected, we can create one side to have more power while the side with the open slit, when a ball strikes the face, will have more flex and, thus, create a softer volley. Conversely, when striking the side where both handle sides press against the ball, the paddle face will not deflect as much and, thus, provide a stiffer ball strike for more powerful shot. The groove enables a paddle having one side for power and a reverse side for control. A urethane membrane can be inserted into the groove to provide damper and more stiffness in the direction of the power stroke.

A still further aspect of the disclosure involves a composite internally pressurized molded paddle including a slit and pass-through window—a slot and pass-through window is created on either side of the paddle to help as well as a window that will pass through the entire handle in the same place as the paddle face, this combination of a slot and window will mechanically aid in creating a softer more flexible paddle on ball impact. Creating this hinge system in the transition of the paddle face and handle allow for improved ball dwell time thus improving control and spin.

The composite internally pressurized molded paddles described above and herein utilize variations in the frame shape to improve the ability to expand flexibility, torsion, and bending in the transition area of the paddle, thus further expanding the possibility to control our ability to manufacture paddles to meet the rapidly changing demands of today's and future players as the advancement of the sport continues to evolve.

An additional aspect of the invention involves a composite molded sports paddle comprising a head with a paddle face; a handle; and a transition area between the head and the handle, wherein the transition area includes a ball dwell control mechanism.

One or more implementations of the aspect of the invention described immediately above includes one or more of the following: the ball dwell control mechanism includes an open throat; the ball dwell control mechanism includes one or more tubular connections forming the open throat; the head includes a thickness, the handle includes a thickness, and the ball dwell control mechanism includes an reduced-thickness paddle throat section having a thickness less than the thickness of the head and thickness of the handle; the paddle face includes a plane and the reduced-thickness paddle throat section is on the same place as the plane of the paddle face; the reduced-thickness paddle throat section includes a handle transition area narrowing perpendicular to the paddle face; the head includes a thickness, the handle includes a thickness, and the ball dwell control mechanism includes an increased-thickness paddle throat section having a thickness greater than the thickness of the head and thickness of the handle; the handle includes a thickness in a direction perpendicular to the paddle face, and the ball dwell control mechanism includes an reduced-thickness paddle throat section having a thickness in the direction perpendicular to the paddle face that is less than the thickness of the handle in the direction perpendicular to the paddle face; the paddle is a two-piece paddle including a first piece with the head and a second piece with the handle, and the ball dwell control mechanism includes a connection section with an elastic material disposed between the head and the handle; the paddle includes opposite facing sides and the paddle face includes opposite facing paddle faces, and the ball dwell control mechanism includes a separation on one of sides of the paddle so that the handle is detached from the paddle face, and on the opposite side of the paddle is one continuous piece from the handle to the paddle face; the ball dwell control mechanism includes a membrane in the separation, and the membrane is configured to at least one of dampen and control stiffness in the sports paddle; the paddle includes opposite facing sides and the ball dwell control mechanism includes at least one of a slot and a window on at least one of the opposite facing sides of the paddle; the ball dwell control mechanism includes a hinge; and/or the paddle face includes a plane and the ball dwell control mechanism includes a window that passes through an entirety of the handle in the same place as the plane of the paddle face.

An additional aspect of the invention involves a method of using a composite molded sports paddle comprising a head with a paddle face; a handle; and a transition area between the head and the handle, the method comprising hitting a ball with the paddle face and using the ball dwell control mechanism to manage dwell time upon ball and paddle impact.

One or more implementations of the aspect of the invention described immediately above includes one or more of the following: the ball dwell control mechanism includes an open throat, and using the ball dwell control mechanism includes using the open throat to increase flexibility and torsion to improve dwell time and, thus, improve control and spin; the head includes a thickness, the handle includes a thickness, and the ball dwell control mechanism includes an reduced-thickness paddle throat section having a thickness less than the thickness of the head and thickness of the handle, and using the ball dwell control mechanism includes using the reduced-thickness paddle throat section to improve flexibility in the throat area, and, thus, improve dwell by having the paddle absorb part of a ball's energy resulting in improved control; the handle includes a thickness in a direction perpendicular to the paddle face, and the ball dwell control mechanism includes an reduced-thickness paddle throat section having a thickness in the direction perpendicular to the paddle face that is less than the thickness of the handle in the direction perpendicular to the paddle face, and using the ball dwell control mechanism includes using the reduced-thickness paddle throat section to improve flexibility of the paddle face in the direction of a shot, improving ball dwell time on the paddle face, ball direction, control, and spin; the paddle is a two-piece paddle including a first piece with the head and a second piece with the handle, and the ball dwell control mechanism includes a connection section with an elastic material disposed between the head and the handle, and using the ball dwell control mechanism includes using the two-piece paddle including the connection section with the elastic material to at least one of control flex dimension and dampen vibration frequency at ball impact; the paddle includes opposite facing sides and the paddle face includes opposite facing paddle faces, and the ball dwell control mechanism includes a separation on one of sides of the paddle so that the handle is detached from the paddle face, and on the opposite side of the paddle is one continuous piece from the handle to the paddle face, and using the ball dwell control mechanism includes using the separation on one of sides of the paddle to create more flex when the ball strikes one paddle face and more power when the ball strikes the oppose facing paddle face; and/or the paddle includes opposite facing sides and the ball dwell control mechanism includes at least one of a slot and a window on at least one of the opposite facing sides of the paddle, and using the ball dwell control mechanism includes using at least one of the slot and the window on at least one of the opposite facing sides of the paddle to mechanically aid in creating a softer more flexible paddle on ball impact.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

With reference to FIGS. 1 to 6B, a number of embodiments of a composite internally pressurized molded paddle, where the shape of the paddles can be significantly altered, particularly in the region where the hitting surface and handle meet, to reduce or increase stiffness and further enhance the bending or stiffness characteristics of the fibrous materials that make up the paddle, will be described. The manipulation of stiffness and bending are directly proportional to ball exit velocity, increased dwell time for control, and ball spin.

Figure 1:
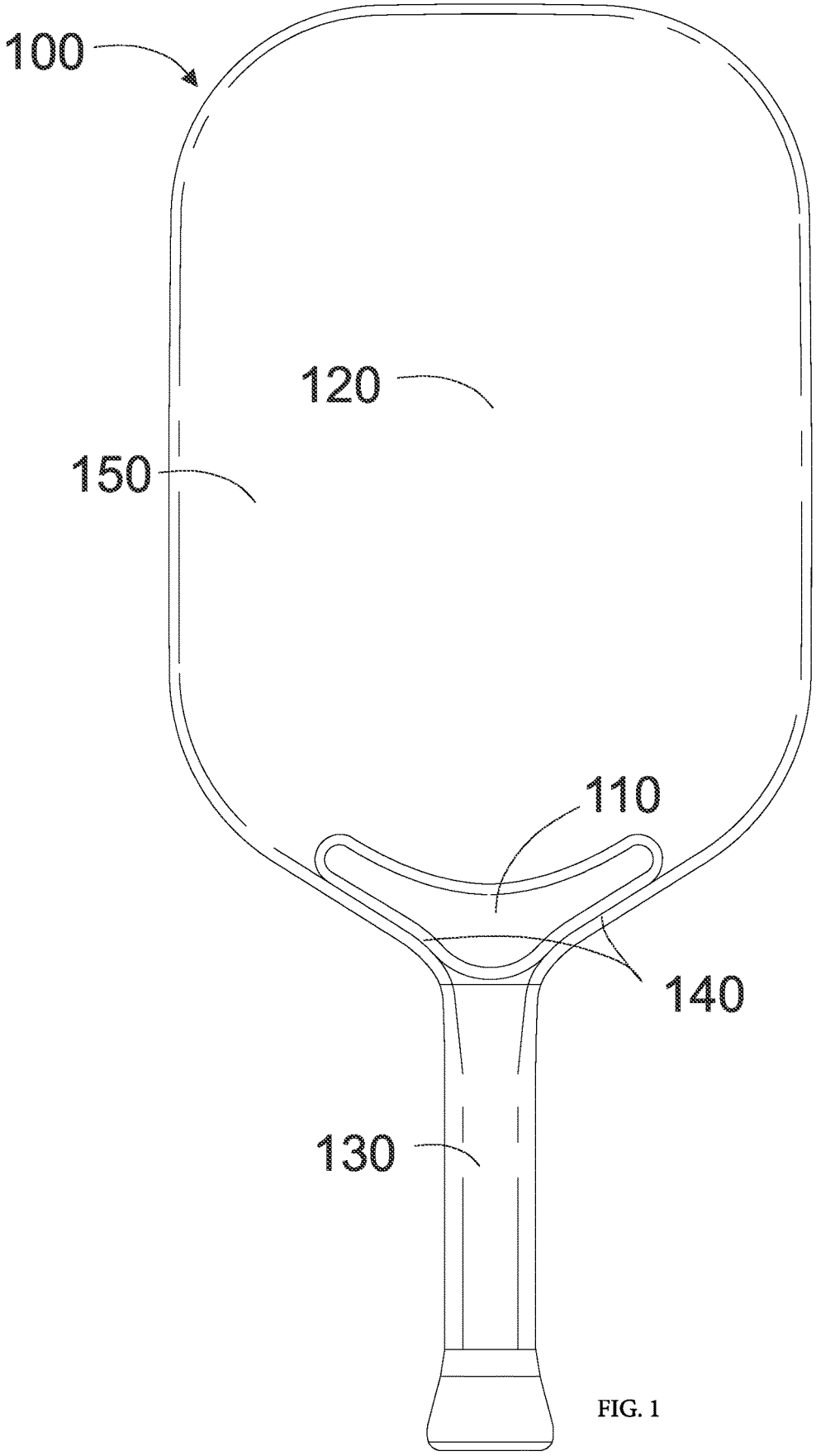
FIG. 1 is a front elevational view of an embodiment of a composite internally pressurized molded paddle including an open throat design.

With reference to FIG. 1, an embodiment of a composite internally pressurized molded paddle 100 including an open throat 110 can be created with the connection of paddle face/hitting surface 120 and handle 130 having one or two tubular connections 140 between a head 150 and the handle 130 of the paddle 100. Further, the connecting tubular sections 140 can be constructed in varying diameters, shapes, and lengths to help create desired elasticity and resistant moments to manage dwell time upon ball and paddle impact. Creating molded paddles, as opposed to the traditional methods of making pickleball paddles utilizing a honeycomb cut out structure, creating an open throat piece or section was not commercially possible, as the structure of the honeycomb would not be sufficient in strength. With the open throat 110, it is possible to encompass a honeycomb face or fibrous rib structure to make the stringing surface of the paddle 100 join the head 150 of the paddle 100 to the handle 130 by a couple of connection tubular surfaces 140. Equally, in making the open throat 110 and achieve improve bending and torsional enhancements, an opening can be created along a center line near the throat 110 of the paddle 100 on the same plane as a paddle face 120. Creating such a slot on a side and going through and between both paddle faces 120 near the handle 130, a more flexible throat region 110 is created to increase flexibility and torsion to improve dwell time and, thus, improve control and spin.

Figures 2A, 2B:
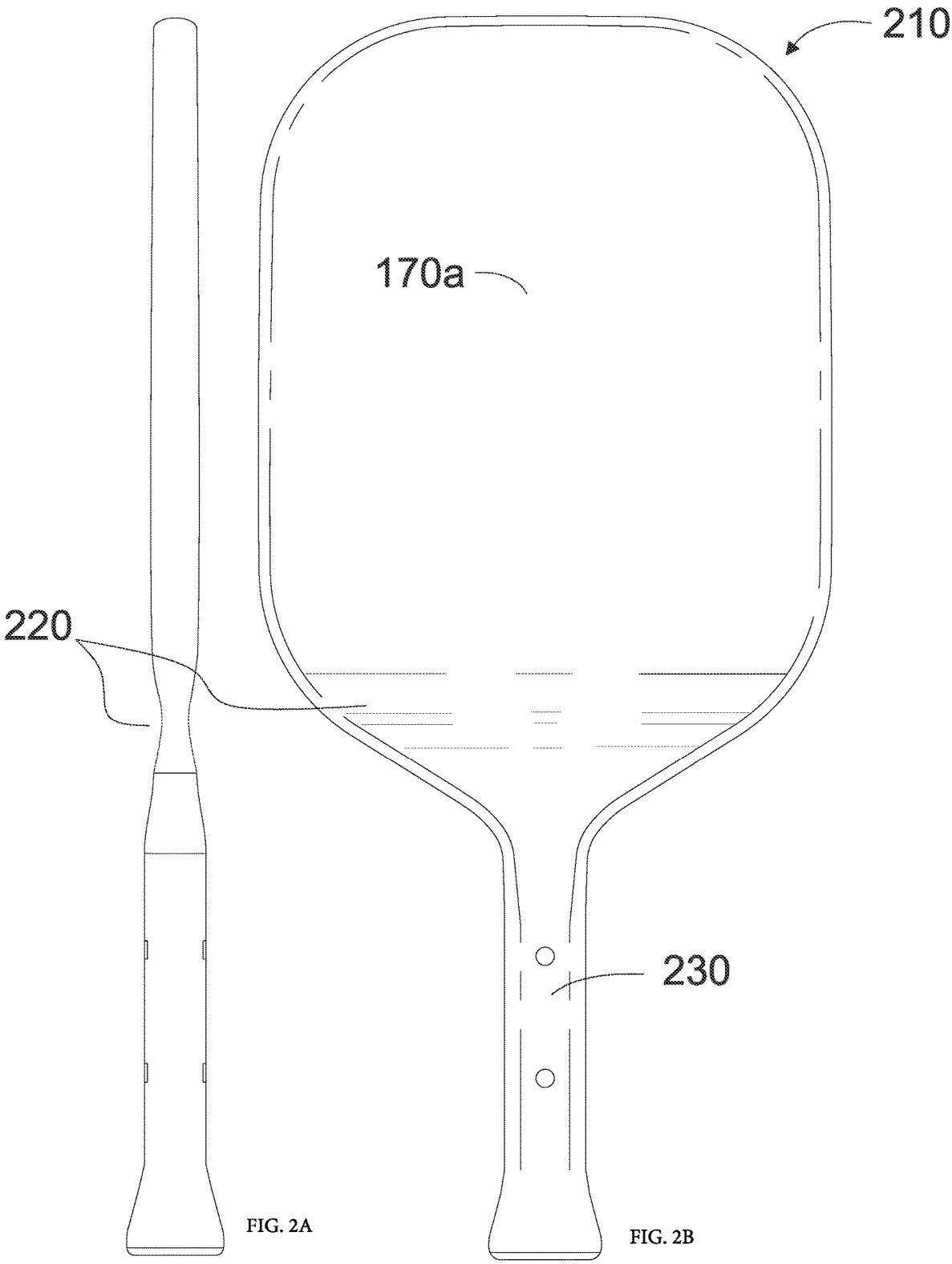
FIGS. 2A, 2B are a left side elevational view and a front elevational view of another embodiment of a composite internally pressurized molded paddle including reduced thickness in a paddle throat section, in the same plane as the face of the paddle.

With reference to FIGS. 2A, 2B, another embodiment of a composite internally pressurized molded paddle 210, in which like elements to those shown and described herein are used with the same reference numbers, but an "a" suffix, includes a reduced-thickness paddle throat section 220, in the same plane as the face 170*a* of the paddle 210. In this aspect, the design is on the same plane as the face 170*a* of the paddle 210 and/or includes a narrowing of handle transition area 230 perpendicular to the striking surface 170*a* of the paddle 210. Thus, creating a narrower transition will improve flexibility in the throat area 220 and, thus, improve dwell by having the paddle 210 absorb part of the balls energy resulting in improved control. To produce a more powerful or stiffer paddle 210, we can increase the thickness at the throat region 220 along the planar direction of the paddle face 170*a* to minimize the paddle's overall flexibility and, thus, return more energy to the ball, resulting in a more powerful shot.

Figure 3:
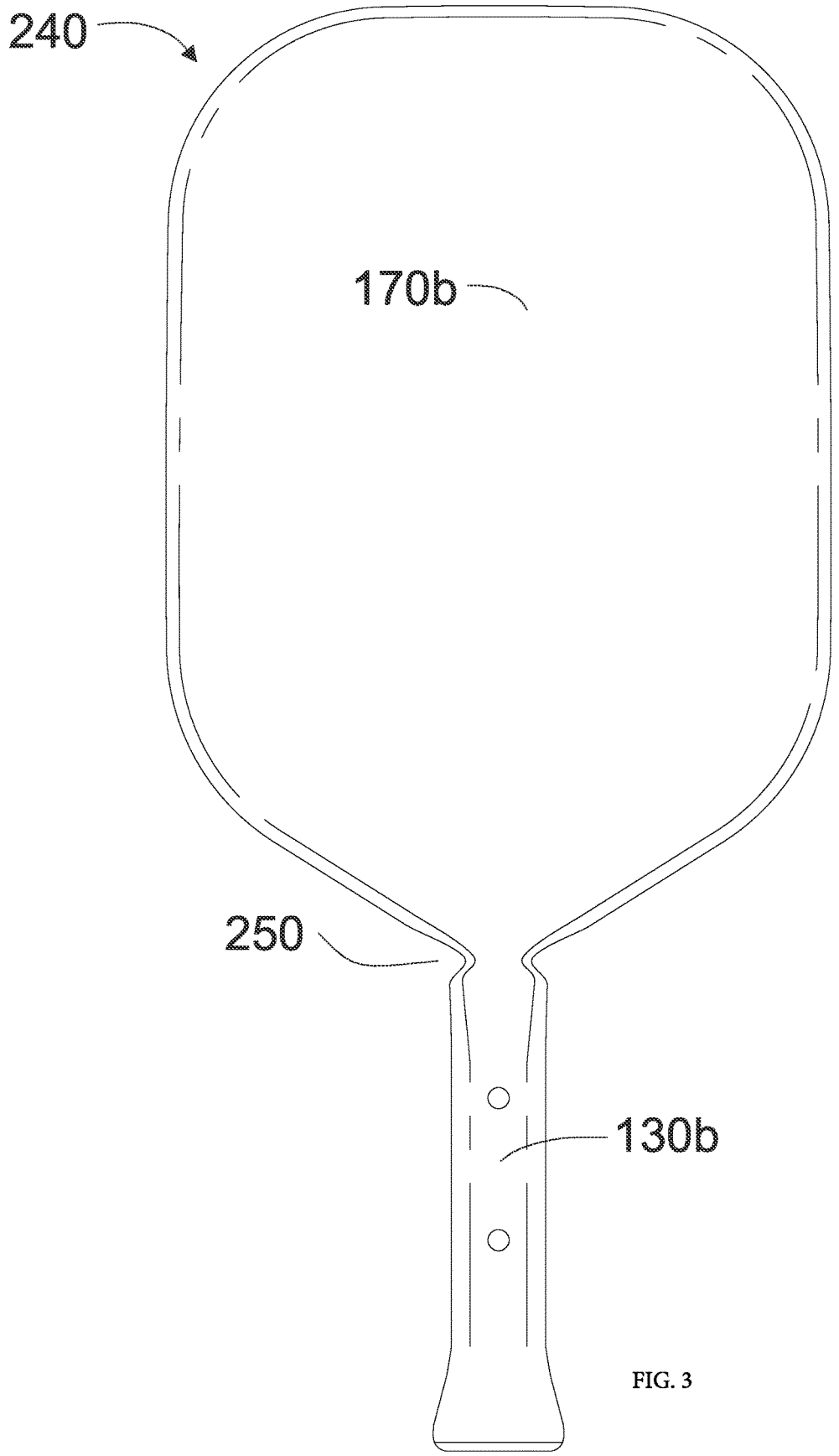
FIG. 3 is a front elevational view of a further embodiment of a composite internally pressurized molded paddle including a reduced thickness in a paddle throat section perpendicular to the face of the paddle.

With reference to FIG. 3, a further embodiment of a composite internally pressurized molded paddle 240, in which like elements to those shown and described herein are used with the same reference numbers, but an "b" suffix, includes a reduced thickness in a paddle throat section 250 perpendicular to the face 170*b* of the paddle 240. A reduced or thinner section 250 at the throat will help create a hinge effect near the handle 130*b* and throat 250 to improve flexibility of the paddle face 170*b* in the direction of the shot. Having the paddle face 170*b* flex in the direction of the shot improves ball dwell time on the paddle face 170*b* and, thus, increasing the time the ball stays on the paddle face 170*b*, this additional time the ball stays on the paddle face 170*b* improves ball direction, more control, and significantly improve spin.

Figure 4:
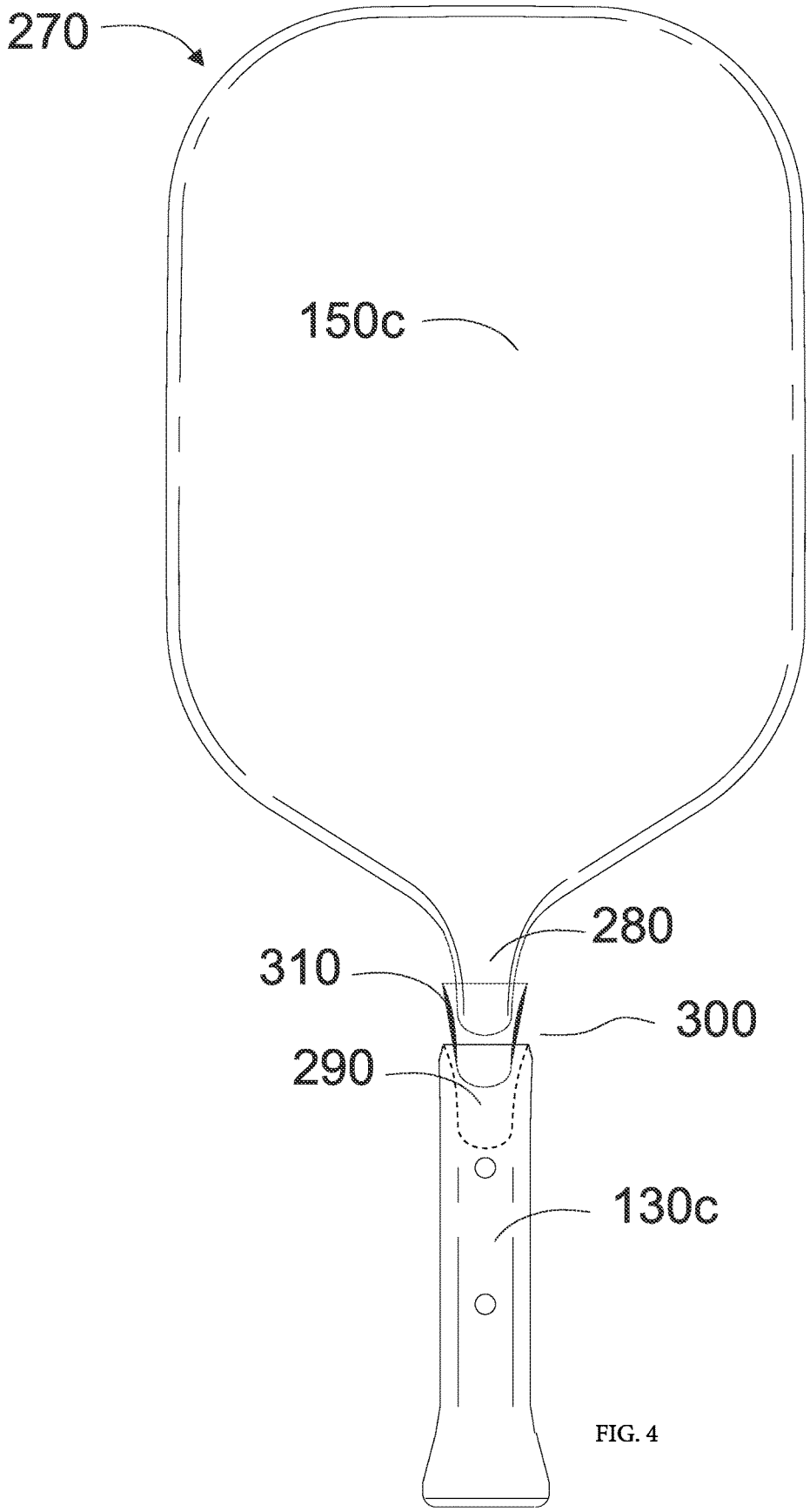
FIG. 4 is a front elevational view of a still further embodiment of a composite internally pressurized molded paddle including a two-piece paddle—one containing the head portion of the paddle and the second the handle of the paddle.

With reference to FIG. 4, a still further embodiment of a composite internally pressurized molded paddle 270, in which like elements to those shown and described herein are used with the same reference numbers, but a "c" suffix, includes a two-piece paddle—a first piece 280 containing the head portion 150*c* of the paddle 270 and the second piece 290 containing the handle 130*c* of the paddle 270. The two pieces 280, 290 would be joined by a slot or connection section 300 in which an elastic material membrane 310 made of rubber or malleable material is sandwiched between the head portion 150*c* and handle section 130*c* in the area where the two pieces 280, 290 come together. In this design, the thickness, durometer and type of malleable material can vary to achieve varying flex dimensions. A further advantage of creating two separate paddle sections is to utilize materials that are vibration absorbing materials to damper the vibration frequency at ball impact.

Figure 5A:
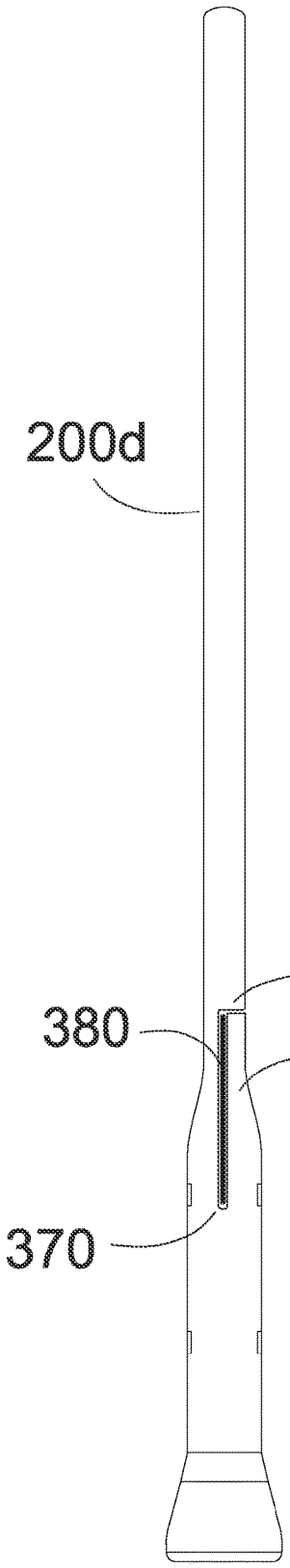
FIGS. 5A, 5B are a left side elevational view and a front elevational view of another embodiment of a composite internally pressurized molded paddle including power and control in one paddle—a slit or separation in the transition area is created, where one side of the face is detached from the handle and face, yet the opposing side remains as one continuous piece.
Figure 5B:
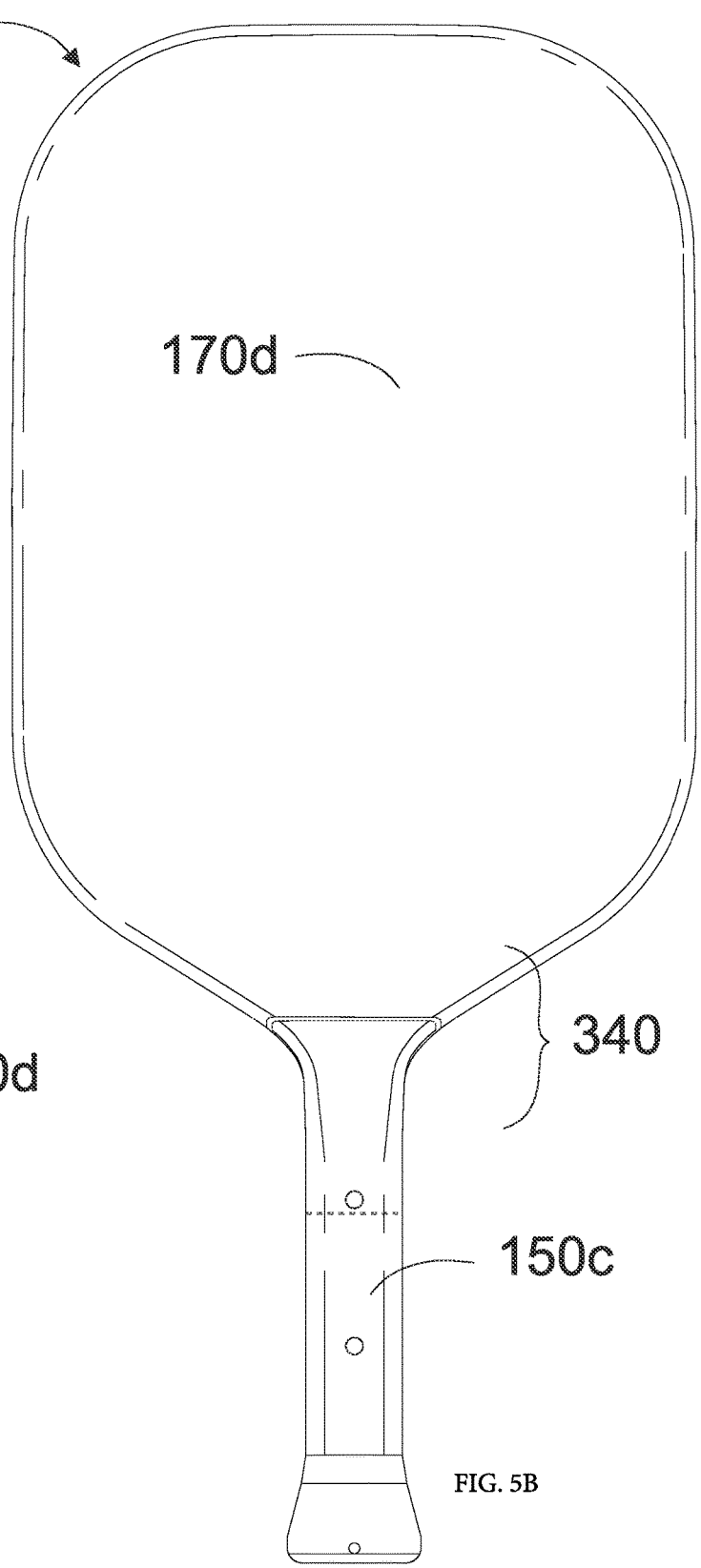

With reference to FIGS. 5A, 5B, an additional embodiment of a composite internally pressurized molded paddle 320, in which like elements to those shown and described herein are used with the same reference numbers, but a "d" suffix, includes power and control in one paddle—a slit or separation 330 in a transition area 340 is created, where one side of the face 170*d* is detached from the handle 130*d* and face 170*d*, yet the opposing side 200*d* remains as one continuous piece. By creating a groove or slit 330 in a center 370 of the handle 130*d* in the planar direction of the paddle face 170*d* and disconnecting one face 170*d*, while leaving the other side 200*d* connected, one side 200*d* is made to have more power while the side 170*d* with the open slit 330, when a ball strikes the face 170*d*, will have more flex and, thus, create a softer volley. Conversely, when striking the side 200*d*, where both handle sides press against the ball, the paddle face 200*d* will not deflect as much and, thus, provide a stiffer ball strike for more powerful shot. The groove 330 create the paddle 320 to be created with one side 200*d* for power and the reverse side 170*d* for control. A urethane membrane 380 can be inserted into the groove 330 to provide damper and/or control stiffness in the direction of the power stroke.

Figure 6A:
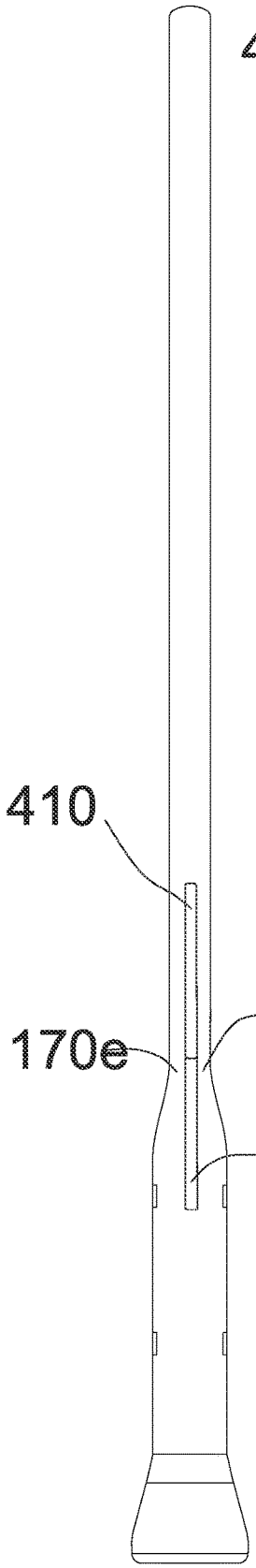
FIGS. 6A, 6B are a left side elevational view and a front elevational view of another embodiment of a composite internally pressurized molded paddle including a slit and pass-through window.
Figure 6B:
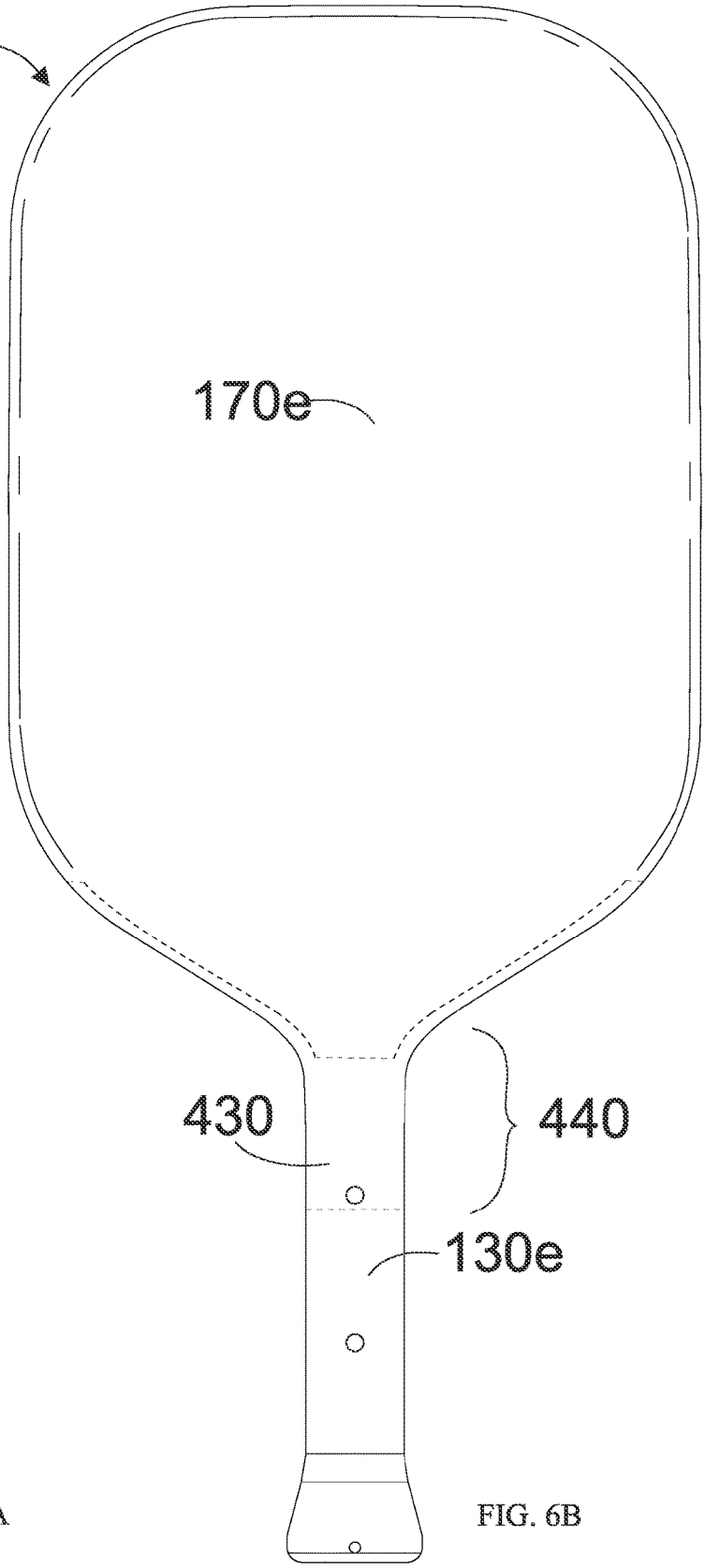

With reference to FIGS. 6A, 6B, another embodiment of a composite internally pressurized molded paddle 400, in which like elements to those shown and described herein are used with the same reference numbers, but an "e" suffix, includes a slot/slit 410 and pass-through window 420—a slot 410 and pass-through window 420 is created on either lateral side 170*e*, 200*e* of the paddle 400 to help as well as the window 420 that will pass through the entire handle 130*e* in the same plane as the head 150 (FIG. 1), this combination of the slot 410 and window 420 will mechanically aid in creating a softer more flexible paddle 400 on ball impact. A hinge system 430 in transition area 440 of the paddle face 170*e* and handle 130*e* allow for improved ball dwell time, and, thus, improving control and spin.

The composite internally pressurized molded paddles 100, 210, 240, 270, 320, 400 described above and herein utilize variations in the frame shape to improve the ability to expand flexibility, torsion, and bending in the transition area of the paddle 100, 210, 240, 270, 320, 400, thus, further increasing the possibility to control the ability to manufacture paddles to meet the rapidly changing demands of todays and future players as the advancement of the sport continues to evolve.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus, the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The invention claimed is:

1. A composite molded sports paddle, comprising:

a head with a paddle face;

a handle comprising a shaft; and a transition area between the head and the handle, wherein the transition area includes a ball dwell control mechanism, wherein the transition area includes a front, a rear, and opposite facing lateral sides, the head includes a plane, and the ball dwell control mechanism comprises a window that passes through an entirety of the shaft in the same plane as the plane of the head.

2. The composite molded sports paddle of claim 1, wherein the window is covered along the front and the rear of the shaft.

3. The composite molded sports paddle of claim 1, wherein the window is located on at least one of the opposite facing lateral sides of the transition area.

4. The composite molded sports paddle of claim 3, wherein the window is covered along the front and the rear of the transition area.

5. A method of using the composite molded sports paddle of claim 1, comprising hitting a ball with the paddle face and using the ball dwell control mechanism to manage dwell time upon ball and paddle impact.

6. The method of claim 5, wherein the window is located on at least one of the opposite facing lateral sides of the transition area, and using the ball dwell control mechanism includes using the window on at least one of the opposite facing lateral sides of the transition area to mechanically aid in creating a paddle that is softer and more flexible on ball impact compared to a paddle without the window.

7. A composite molded sports paddle, comprising:

a head with a paddle face;

a handle comprising a shaft; and a transition area between the head and the handle, wherein the transition area includes a ball dwell control mechanism, wherein the transition area includes a front, a rear, and opposite facing lateral sides, the head includes a plane, and the ball dwell control mechanism comprises the transition area including:

a slot on one of the opposite facing lateral sides of the transition area of the paddle, and a window that passes through an entirety of the shaft in the same plane as the plane of the head.

* * * * *